US006682376B2

(12) United States Patent
Saito

(10) Patent No.: US 6,682,376 B2
(45) Date of Patent: Jan. 27, 2004

(54) TILT DEVICE FOR OUTBOARD ENGINE

(75) Inventor: Hideaki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 10/063,147

(22) Filed: Mar. 26, 2002

(65) Prior Publication Data

US 2002/0146945 A1 Oct. 10, 2002

(30) Foreign Application Priority Data

Apr. 9, 2001 (JP) ..... 2001-110059

(51) Int. Cl.[7] ..... B63H 5/125

(52) U.S. Cl. ..... 440/61 D; 440/61 G

(58) Field of Search ..... 440/61 R–61 J

(56) References Cited

U.S. PATENT DOCUMENTS 5,975,968 A * 11/1999 Nakamura ..... 440/61

* cited by examiner

*Primary Examiner*—Ed Swinehart
(74) *Attorney, Agent, or Firm*—Ernest A Beutler

(57) ABSTRACT

A hydraulic tilt and trim device for a marine propulsion unit and a method of forming such a device. This is done by utilizing a cast in pipe that is cast into the molded housing assembly for the tilt and trim device and which can be subsequently machined so as to form complete passages for the hydraulic system and thus minimizing the number of drilled and bored passages that must be formed.

17 Claims, 13 Drawing Sheets

FIG. 9
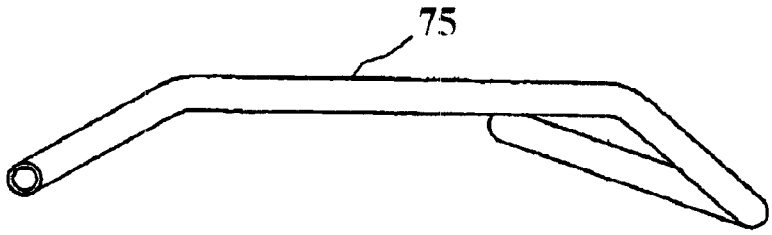
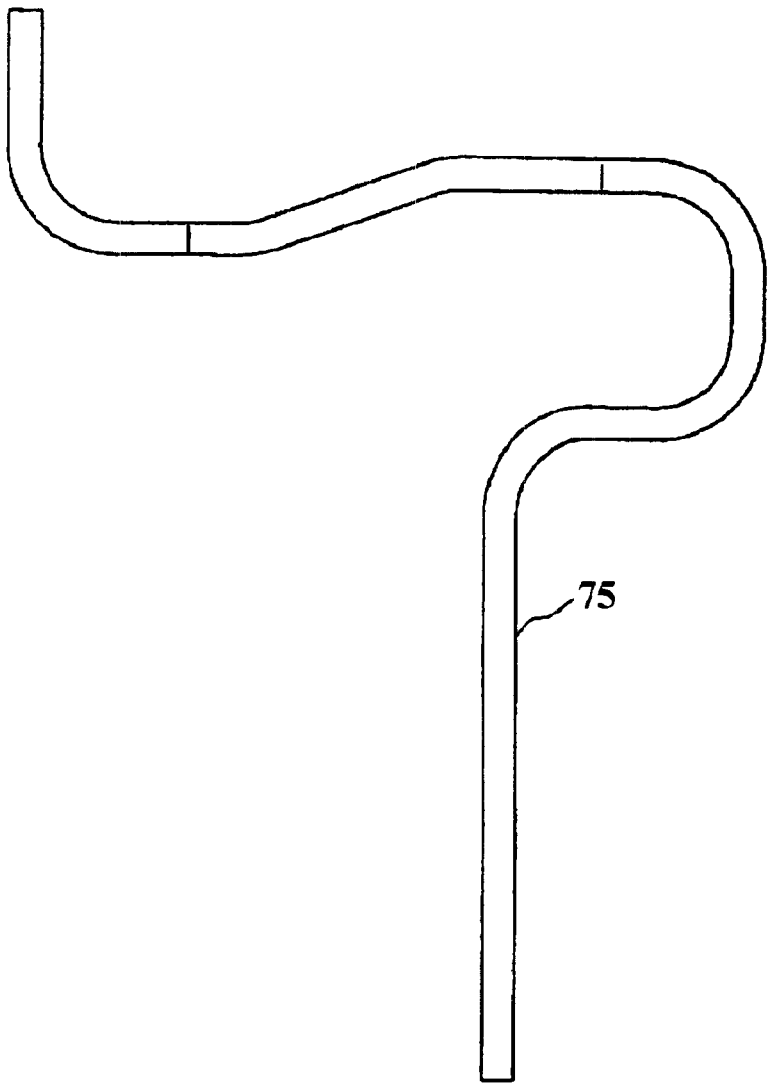
FIG. 10

TILT DEVICE FOR OUTBOARD ENGINE

BACKGROUND OF INVENTION

This invention relates to a tilt device for a marine propulsion unit and more particularly to an improved and simplified method of forming the housing assembly for such a unit.

Various tilt and trim devices have been proposed for hydraulically controlling the position of a marine propulsion unit. These devices may provide either trim or tilt up operation or a combination of them. The device is generally mounted as a unit between the watercraft hull and the propulsion unit and has one or more fluid motors that cooperate with the propulsion unit to adjust its position. Obviously it is desirable to provide a compact assembly and nevertheless, one which is capable of providing the desired control for the propulsion unit.

Generally these units include one or more tilt and/or trim cylinders, a reversible electric motor, a reversible hydraulic pump driven by the electric motor and a control valve assembly for controlling the flow of fluid from a reservoir to the pump, from the pump to the cylinder or cylinders and a return from these cylinders to the reservoir. Obviously this requires a number of passages to be formed in the housing assembly.

Generally the housing assembly is a cast member and the various passages are formed by drilling the casting. Where angularly related passages are required, they are provided by cross drillings with the resulting open ends of certain of these drilling being plugged to provide desired fluid path.

A disadvantage results from the use of these multiple drilled passages. That is, the machining operation can leave foreign particles in the body even though cleaning operations are performed after the drilling has been completed. These foreign materials can mix with the hydraulic fluid and can in extreme instances cause problems in operation. Furthermore, they can decrease the durability of the unit.

It is, therefore, a principle object to this invention to provide an improved marine propulsion control device of this type wherein the number of drilled passages can be substantially reduced.

It is a further object to this invention to provide an improved construction and method for forming passages in an device of this type.

SUMMARY OF INVENTION

A first feature of this invention is adapted to be embodied in a cast housing for a hydraulic tilt and trim arrangement for a marine propulsion device. The cast housing defines a cylinder for receiving a piston for controlling the position of the marine propulsion device, a fluid reservoir for containing a fluid, a pumping chamber for containing a fluid pump, a valve chamber for containing a control valve and a conduit for communicating the fluid reservoir with the valve chamber, the valve chamber with the cylinder and the valve chamber with the pumping chamber. At least a portion of the conduit is formed by a pipe that is molded into the cast housing when the cast housing is molded to minimize drilled passages in the cast housing.

Another feature of the invention is adapted to be embodied in a method for forming a cast housing as set forth in the previous paragraph. In accordance with this method, a pipe is formed in a desired configuration and the pipe is molded into the cast housing when the cast housing is molded so as to minimize the drilled passages.

BRIEF DESCRIPTION OF DRAWINGS

FIG. 9 is a top plan view of the cast in flow passage forming tube utilizing an embodiment of the invention.

FIG. 10 is a front elevational view of the flow passage forming tube.

DETAILED DESCRIPTION

Figure 1:
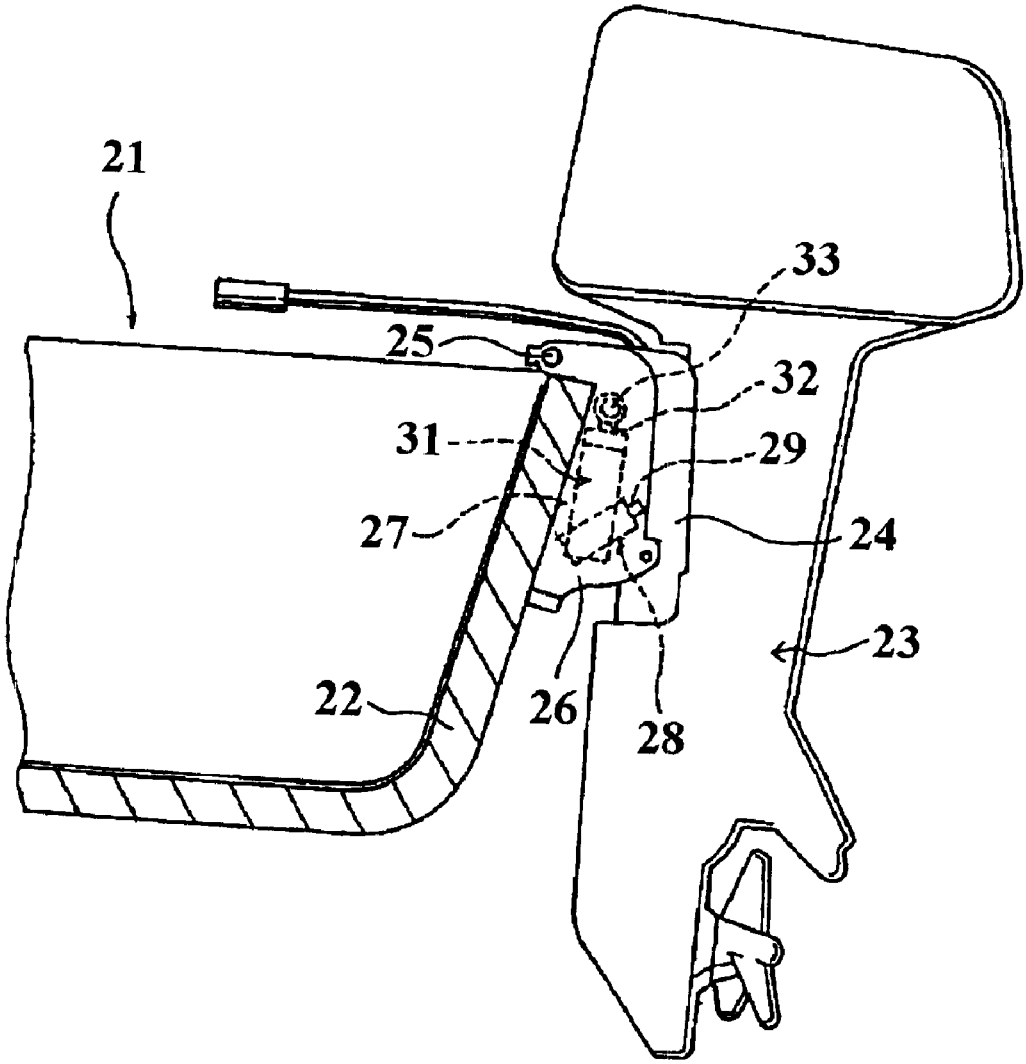
FIG. 1 is a side elevational view of a marine propulsion system constructed in accordance with an embodiment of the invention shown attached to the transom of an associated watercraft that is partially illustrated in cross section.

Referring now in detail to the drawings and initially primarily to FIG. 1, a watercraft and attached propulsion system embodying the invention is shown partially and identified generally by the reference numeral 21. The watercraft hull is partially shown in cross section at 22. In this embodiment, a marine propulsion system, indicated generally by the reference numeral 23, is comprised primarily of an outboard motor.

Although the invention is described in conjunction with an outboard motor, it also will be readily apparent to those skilled in the art that the invention can be utilized equally as well with an inboard/outboard drive. For that reason, the details of the outboard motor or propulsion unit 23 are not described in total. Only those components which will permit those skilled in the art to understand how the invention is utilized will be described.

These include a swivel bracket 24 about which the propulsion unit 23 may be steered for steering movement about a generally vertically disposed steering axis defined by the swivel bracket 24. The swivel bracket 24 is, in turn, pivotally connected by a pivot pin 25 to a clamping bracket 26. As may be best seen in FIG. 2, the clamping bracket 26 is comprised of a pair of side plates 26A and 26B that journal the swivel bracket 24 via the pivot pin 25.

Figure 2:
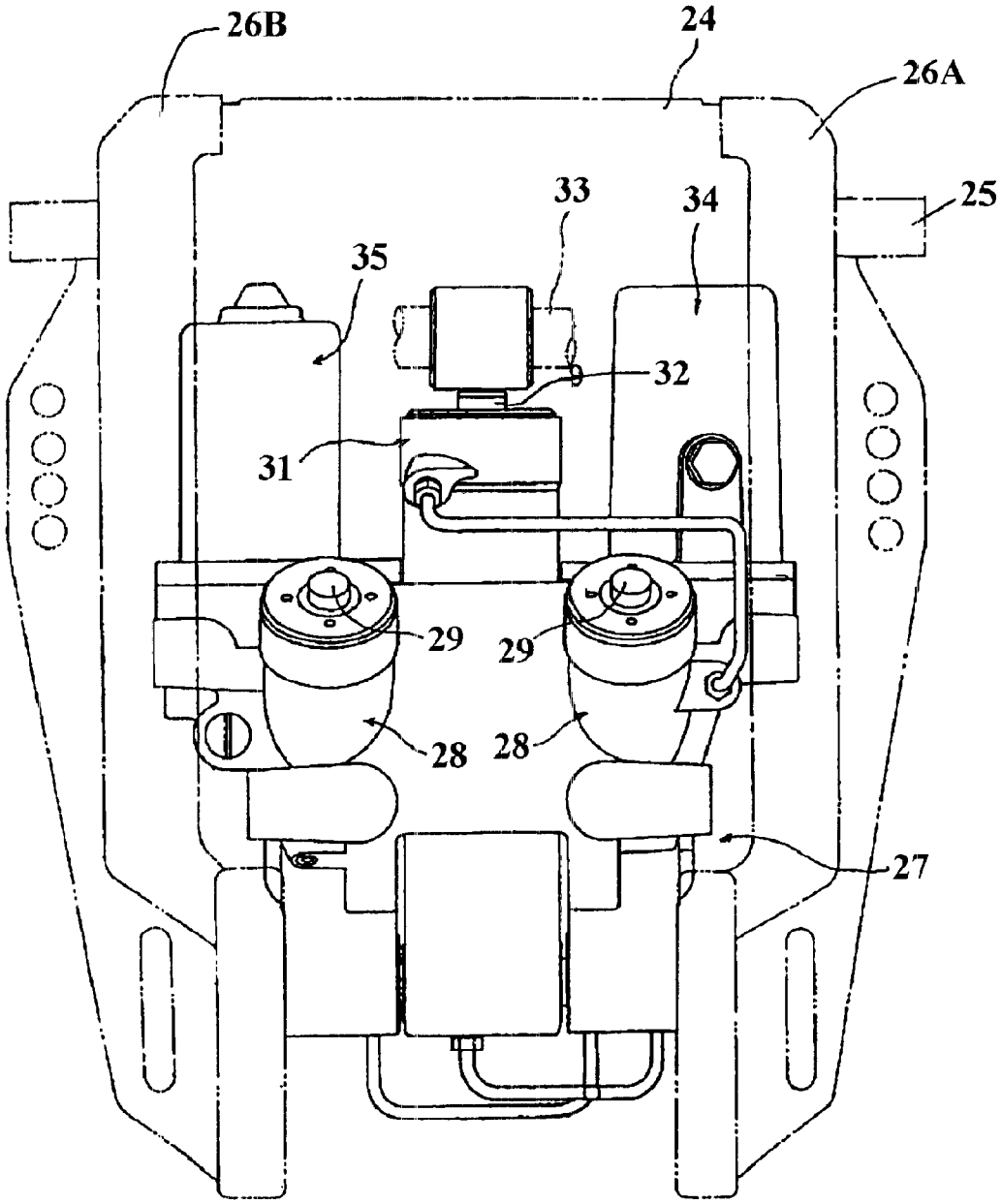
FIG. 2 is a front elevational view showing the hydraulic tilt and trim arrangement in solid lines and the associated components of the marine propulsion system in phantom lines.

The invention is particularly embodied in a hydraulic tilt and trim unit, indicated generally by the reference numeral 27 and shown in more detail in FIG. 2. This tilt and trim unit 27 in the described embodiment comprises a pair of trim cylinders 28 each of which has a trim piston 29 that is abuttingly engaged with the swivel bracket 24 so as to adjust the trim position of the marine propulsion unit 23 in manner that is generally well known in this art.

In addition, the unit 26 includes a tilt cylinder 31 which includes a tilt piston, to be described, to which a piston rod 32 is affixed and which extends outwardly beyond one end of the tilt cylinder 31. This piston rod 32 is connected to a pivot pin 33 provided on the marine propulsion unit 23 so as to effect tilt up of the marine propulsion device 23 in a manner which will be described.

In addition, the tilt cylinder 31 includes a system which prevents tilting up of the propulsion device 23 when operating in reverse and which will nevertheless permit the outboard drive 23 to pop up when an underwater obstacle is struck when traveling forward. Conventionally, these mechanisms also employ memory pistons so that once the propulsion unit 23 clears the underwater obstacle its weight will return it to the previously adjusted trim position set by the trim pistons 23.

The tilt and trim device 27 also includes a reservoir forming member 34 which is disposed at one side of a main housing assembly, to be described in more detail later and which holds fluid for the operation of the device.

Mounted on the opposite side of the tilt cylinder 31 from the reservoir 34 is a reversible electric motor 35, which, in turn, drives a reversible hydraulic pump for operating the trim cylinders 28 and the tilt cylinder 31 in a manner, which will now be described by reference to FIG. 3.

Figure 3:
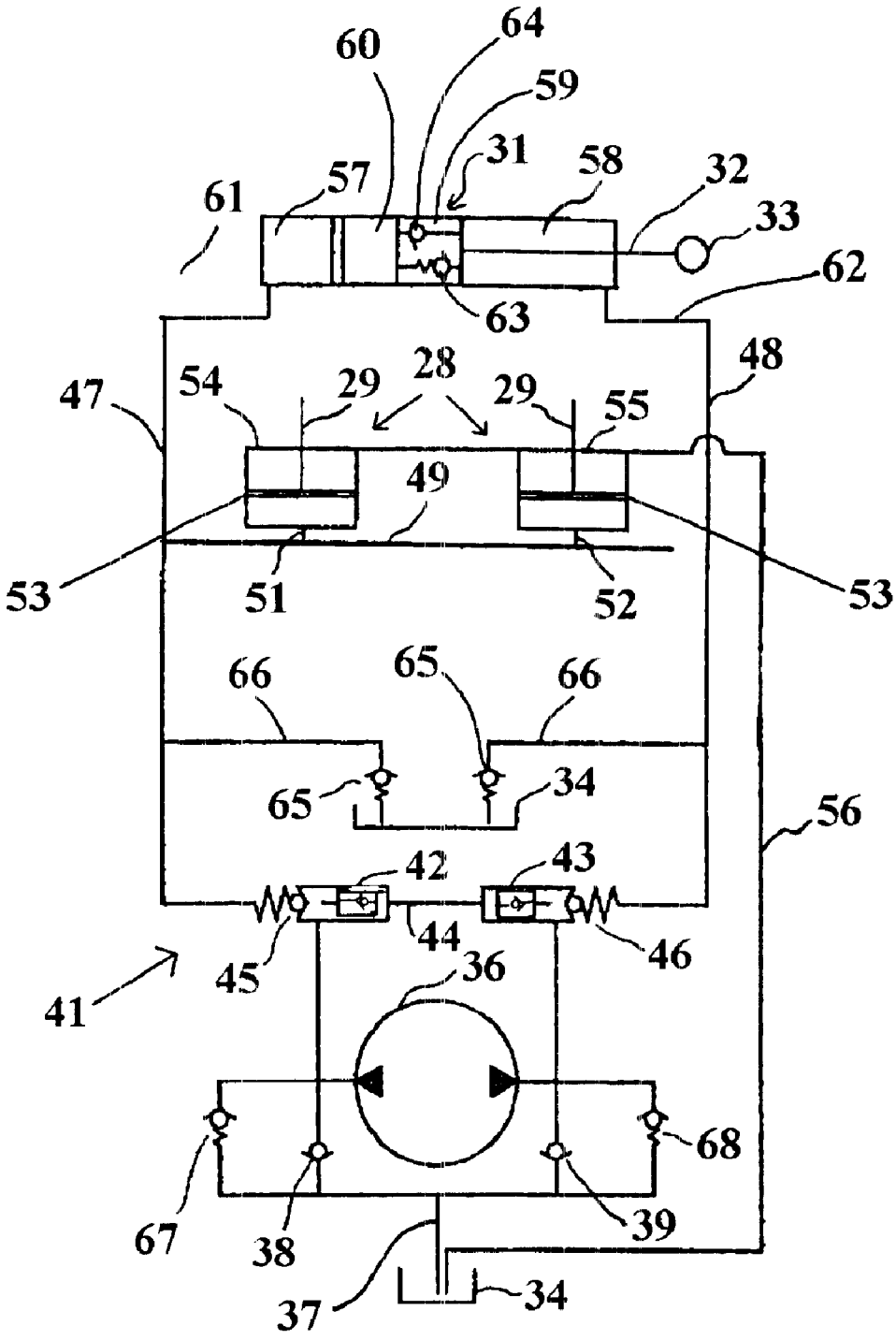
FIG. 3 is a hydraulic schematic diagram of the tilt and trim system.
Figure 4:
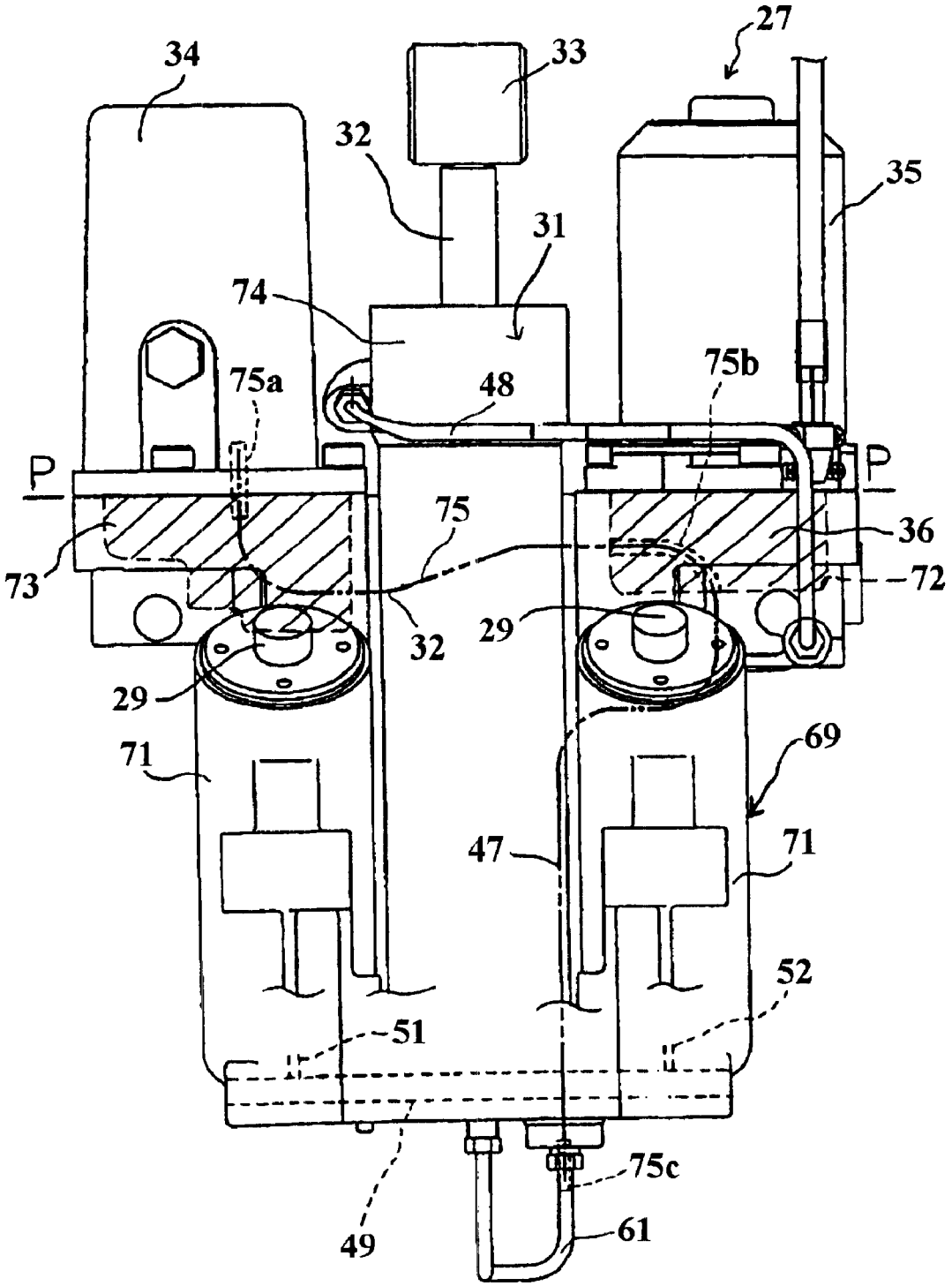
FIG. 4 is a view, in part similar to FIG. 2, but shows the hydraulic tilt and trim unit constructed in accordance with the invention.
Figure 5:
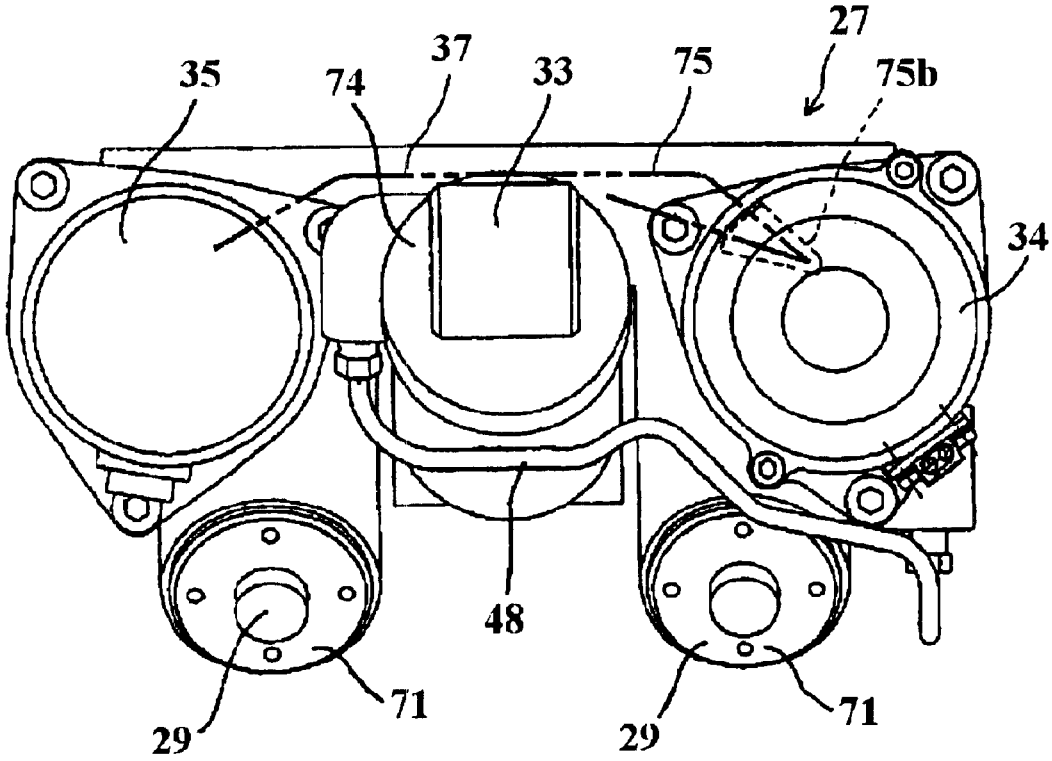
FIG. 5 is a top plan view of the construction shown in FIG. 4.
Figure 6:
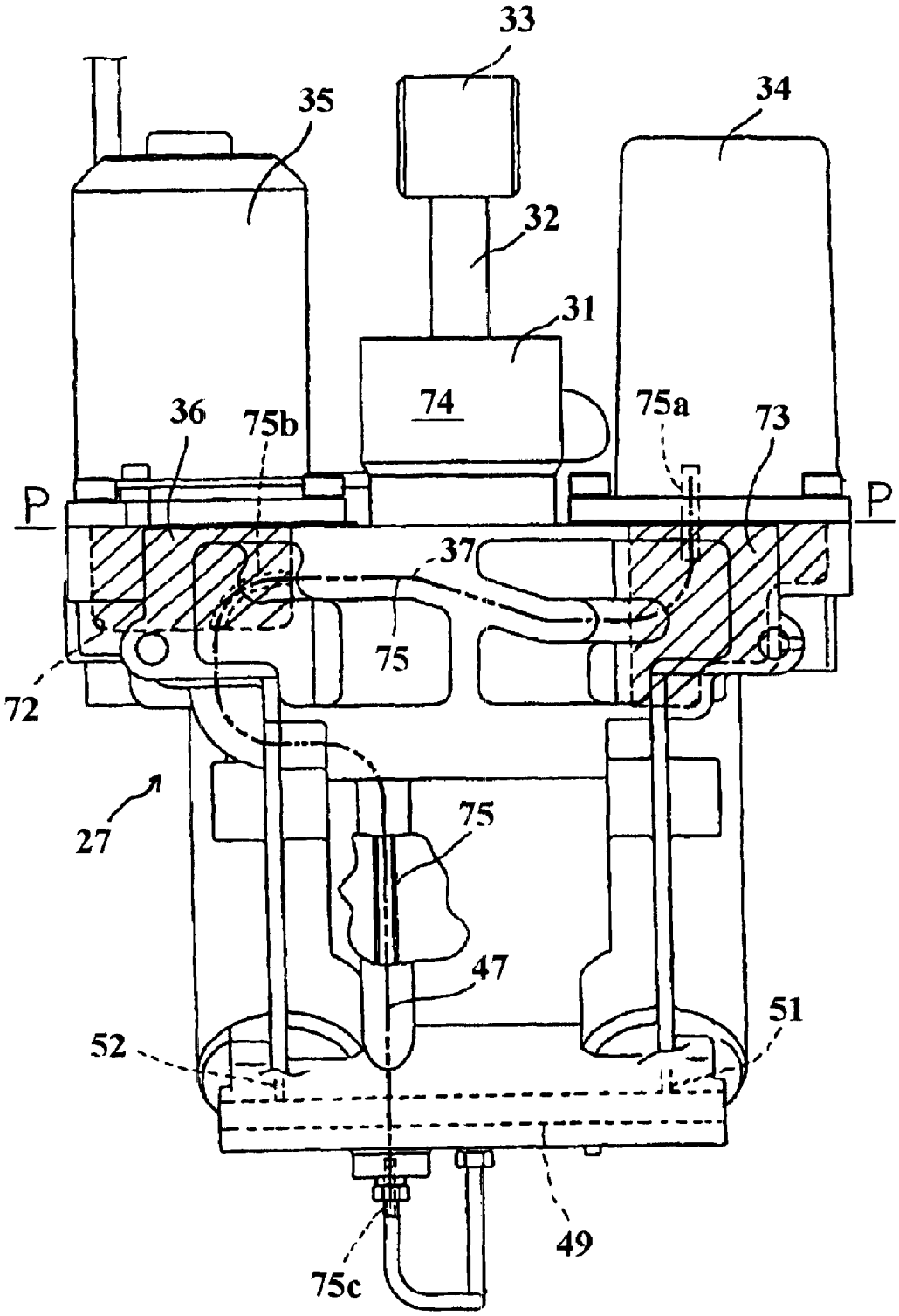
FIG. 6 is a rear elevational view of the hydraulic tilt and trim unit.
Figure 7:
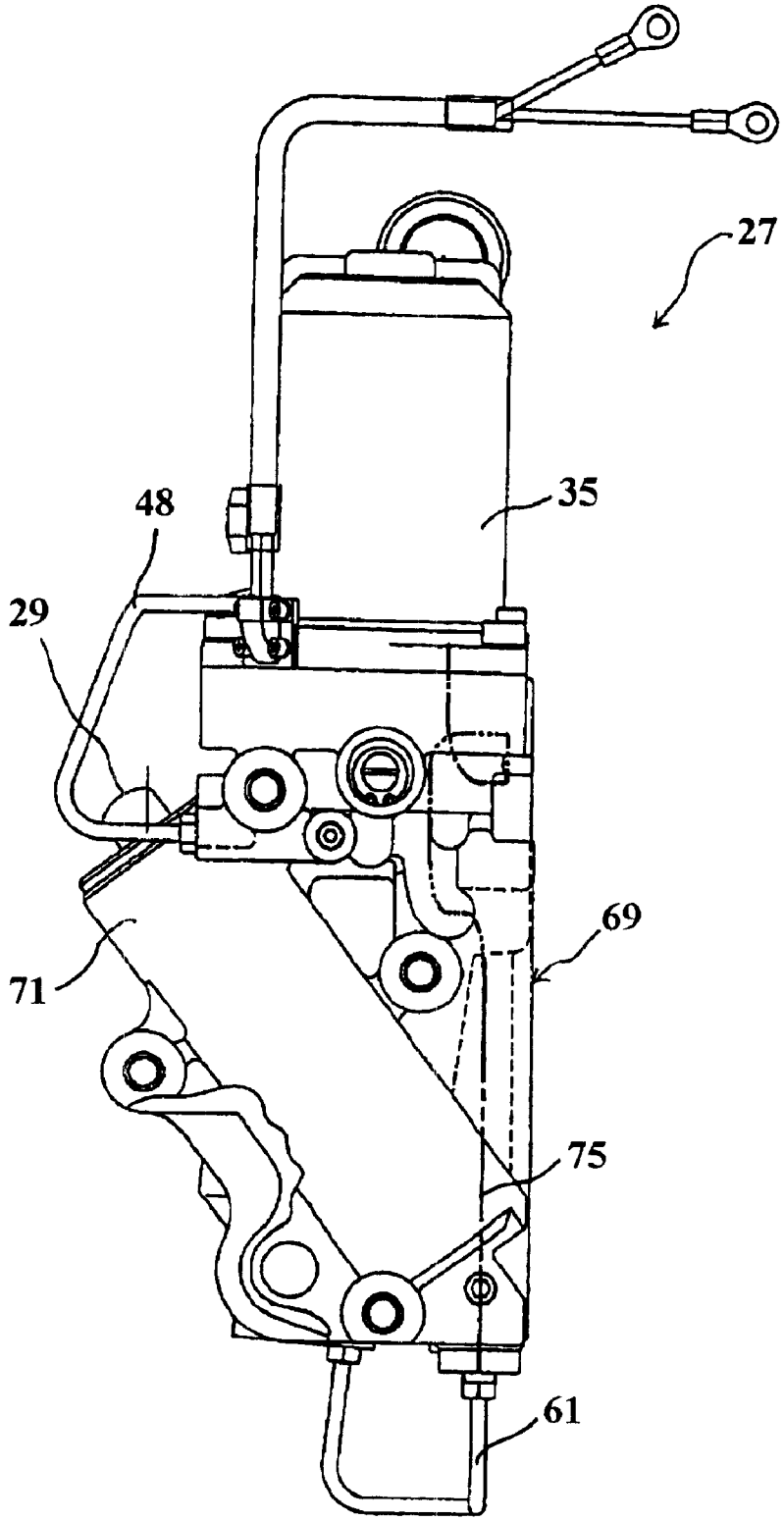
FIG. 7 is a side elevational view of the hydraulic tilt and trim unit.
Figure 8:
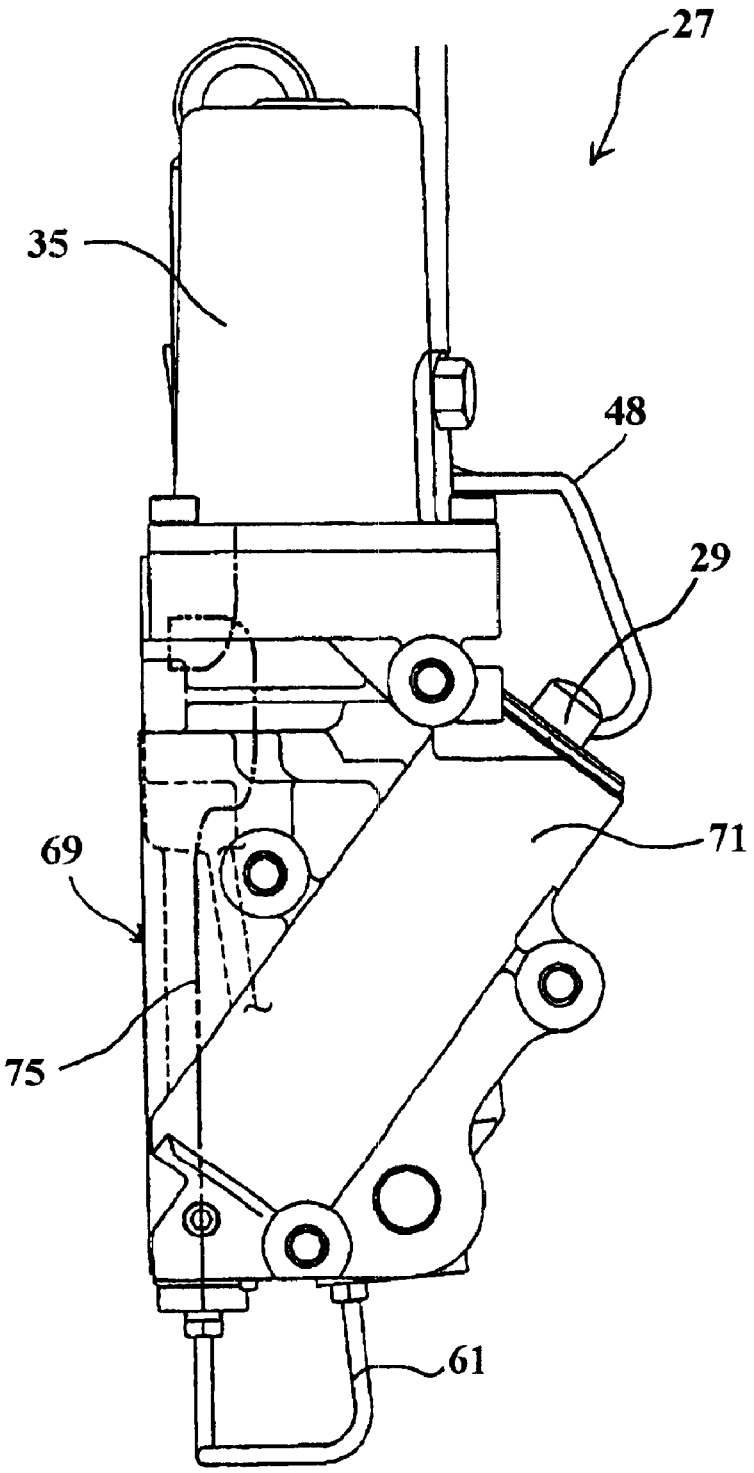
FIG. 8 is a side elevational view of the opposite side from that shown in FIG. 7.

Referring now in detail to FIG. 3, this is a hydraulic circuit diagram for the tilt and trim unit 27. Except for the manner in which it is formed, it may be considered to be of a conventional or prior art type of construction.

It has been noted that the reversible electric motor 35 drives a reversible hydraulic pump and that pump is indicated schematically at 36. The pump 36 has a pair of ports, which communicate with the reservoir 34 through a supply line 37. Check valves 38 and 39 are provided in conduits that extend to these ports of the pump 36 and also to ports of a shuttle valve assembly, indicated generally by the reference numeral 41.

This shuttle valve assembly 41 is of a generally conventional type and includes a pair of shuttle pistons 42 and 43, which control the flow to both the trim cylinders 28 and the tilt cylinder 31. These shuttle pistons 42 and 43 have one-way valves that permit flow from their pressure chambers to an interconnecting passageway 44 and operate in a manner, which will be described shortly.

The shuttle pistons 42 and 43 also have projecting pins that are adapted to operate a tilt and trim up check valve 45 and a tilt and trim down check valve 46 each positioned between the conduits from the pump ports to a trim up line 47 and trim down line 48, respectively. The trim up line 47 is interconnected by a first passageway 49, which communicates through passageways 51 and 52, to the trim cylinders 28 and more particularly to an area thereof that is below trim pistons 53 positioned therein and to which the aforementioned piston rods 29 are connected.

The piston rods 29 extend through openings in the trim cylinders 28 and the upper side of the chambers formed by the pistons 53 communicate with return lines 54 and 55, respectively, that communicate with a trim up return line 56. The trim up return line 56 communicates directly with the fluid reservoir 34.

The trim lines 47 and 48 also communicate with a tilt up chamber 57 and a tilt down chamber 58 formed on opposite sides of a tilt piston 59 to which the tilt piston rod 32 is connected. This piston rod 32 extends through the chamber 58. In addition, a floating, memory piston 60 may be positioned in the chamber 57 for a purpose to be described.

The tilt up line 47 communicates with the chamber 57 through a tilt up conduit 61. The tilt down line 48 communicates with the chamber 58 through a tilt down conduit 62.

The tilt piston 57 carries an absorber valve 63 and a return valve 64 for a purpose, which will be described shortly. That is and as is typical with this type of arrangement, the tilt cylinder 31 acts as a hydraulic damper to hold the propulsion unit 23 from popping up when operating in a reverse mode, but to permit this popping up when an underwater obstacle is struck when traveling in a forward direction.

When that happens, the absorber valve 63 will open and permit fluid to flow from the chamber 58 to the area between the tilt piston 59 and the memory piston 60. When the underwater obstacle is cleared, the weight of the propulsion unit 23 will cause the relief valve 41 to open and the fluid will return to the chamber 58 so that the propulsion unit 23 returns to its previously adjusted position.

A pair of manually operated valves 65 are provided in a return line 66 which communicate the tilt cylinder chambers 57 and 58 with the reservoir 34 so as to permit manual tilt up of the propulsion unit 23 if desired.

It should also be noted that there are provided tilt up and tilt down relief valves 67 and 68 which will open to provide bypassing of fluid back to the reservoir 34 from the pump 36 in the event unduly high loads are encountered.

As has been previously noted, the hydraulic structure and specifically the hydraulic circuitry is of a conventional type. However, in order to facilitate the understanding of the invention, its operation will be described in some detail so that the necessity for the various fluid passages can be understood and the value of the invention more fully appreciated.

Continuing to refer primarily to FIG. 3, assuming the propulsion device 23 is in a trim adjusted position and it is desired to trim or tilt up from that position, the operator energizes a switch so as to operate the electric motor 35 and accordingly drive the fluid pump 36. This is effected in such a direction so that the check valve 39 will open and permit the pump to draw fluid through its port shown to the right in this figure. This port acts as a suction port at this time and pressure is delivered through the left hand port to the chamber containing the shuttle piston 42. This pressure will open the check valve 45 and permit the line 47 to be pressurized.

The pressure on the shuttle piston 42 will cause it to shift to the right pressuring the chamber 44 and urging the shuttle piston 43 to the right. This will unseat the check valve 46 and permit the lines 62 and 48 to act as return lines.

Pressure is delivered to the trim cylinders 28 through the connections 51 and 52 and because the larger diameter of the trim pistons 53, they will move upwardly against the propulsion force of the propulsion device 23 to make a trim up adjustment during running. Of course, the chamber 57 of the tilt cylinder 31 will also be energized and the pistons 60 and 59 will be urged to the right expelling fluid from the chamber 58 through the opened check valve 46 back to the suction side of the pump 36 to augment the fluid flow.

If this operation is continued until the total trim up operation has been completed, and the operator continues to hold the switch in this position, then the device will tilt up. Since the trim pistons 53 are at the ends of their up stroke, all fluid flow from the pump 36 will be delivered to the tilt cylinder 31 and specifically the chamber 57 thereof.

Tilt and trim down occurs when the operator operates a switch to reverse the direction of rotation of the electric motor 35 and the fluid pump 36. When this occurs, the check valve 38 will open and the previous pressure side of the pump 36 will now become the return or suction side of the pump 36.

The shuttle piston 43 will then be actuated due to pressurization and shift to the left to actuate the shuttle piston 42 and open the check valve 45. The fluid pressure will open the check valve 46 and fluid will flow through the lines 48 and 62 to the tilt cylinder chamber 58 causing it to be moved downwardly. Fluid is expelled from the chamber 57 through the lines 61 and 47 and open check valve 45 back to the suction side of the pump 36.

This movement will continue until the piston rods 29 of the trim cylinders 28 are engaged by the swivel bracket 24. If the pump operation is continued, the trim pistons 53 will be urged downwardly and fluid will be expelled from their chambers through the lines 51 and 52, which now act as return lines.

If at any time during either up or down movement the fluid pressure becomes excessive, the respective tilt and trim up check valves 57 will open to permit fluid to bypass back to the reservoir 34.

Thus, having explained how the fluid system operates, the way in which the fluid passages or at least some of them are formed in the actual physical unit will be described referring now to the remaining figures.

The hydraulic tilt and trim unit 27 includes a cast main body indicated generally at 69 on which the reversible electric motor 35 and the reservoir forming member 34 are mounted. The trim cylinders 28 are formed in protrusions 71 formed on right and left sides of the cast main body 69. The cast main body 69 is a casting molded from an appropriate metal using a mold.

Figure 13:
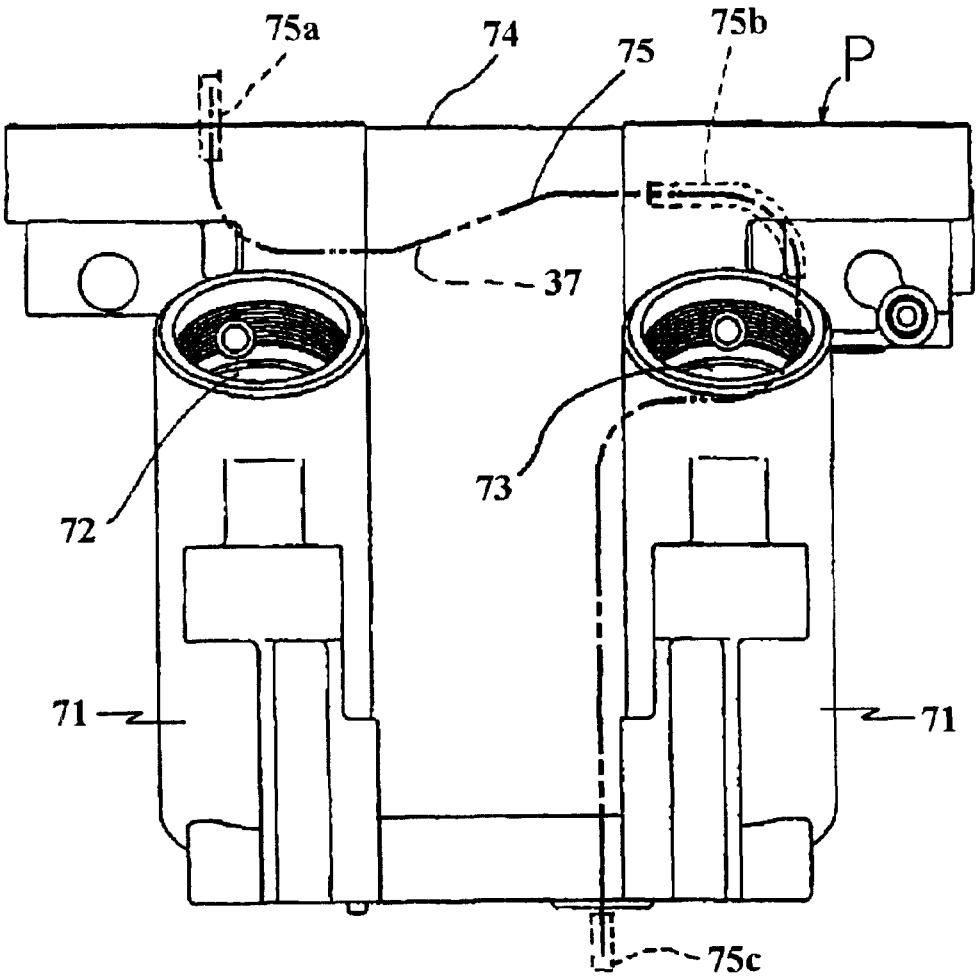
FIG. 13 is a view, in part similar to FIG. 4, but again showing only the casting embodying the invention.

The cast main body 69 has a dividing upper surface indicated at P on which the motor 35 and the reservoir forming member 34 are fixed. A hydraulic pumping chamber 72 (hatched portion) in which the reversible pump 36 is contained and an oil reservoir chamber 73 (hatched portion) that cooperates with the reservoir forming member 34 to form the complete oil reservoir. These chambers 72 and 73 have respective opening at the dividing surface P and formed in an upper part of the cast main body 69 (see FIGS. 13 and 14). The reversible electric motor 35 is fixed to closing the hydraulic pumping chamber opening 72 at the top thereof.

The cast main body 69 also has a cylindrical portion 74 that forms the cylinder for the tilt cylinder 31.

Figure 11:
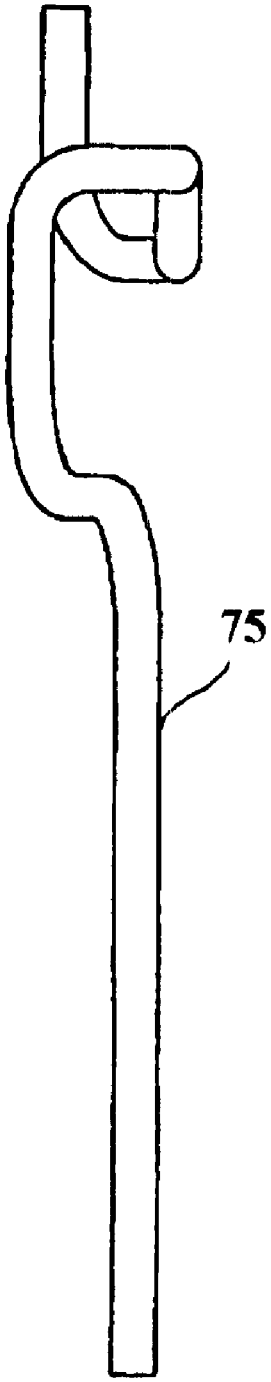
FIG. 11 is a side elevational view of the flow passage forming tube.
Figure 12:
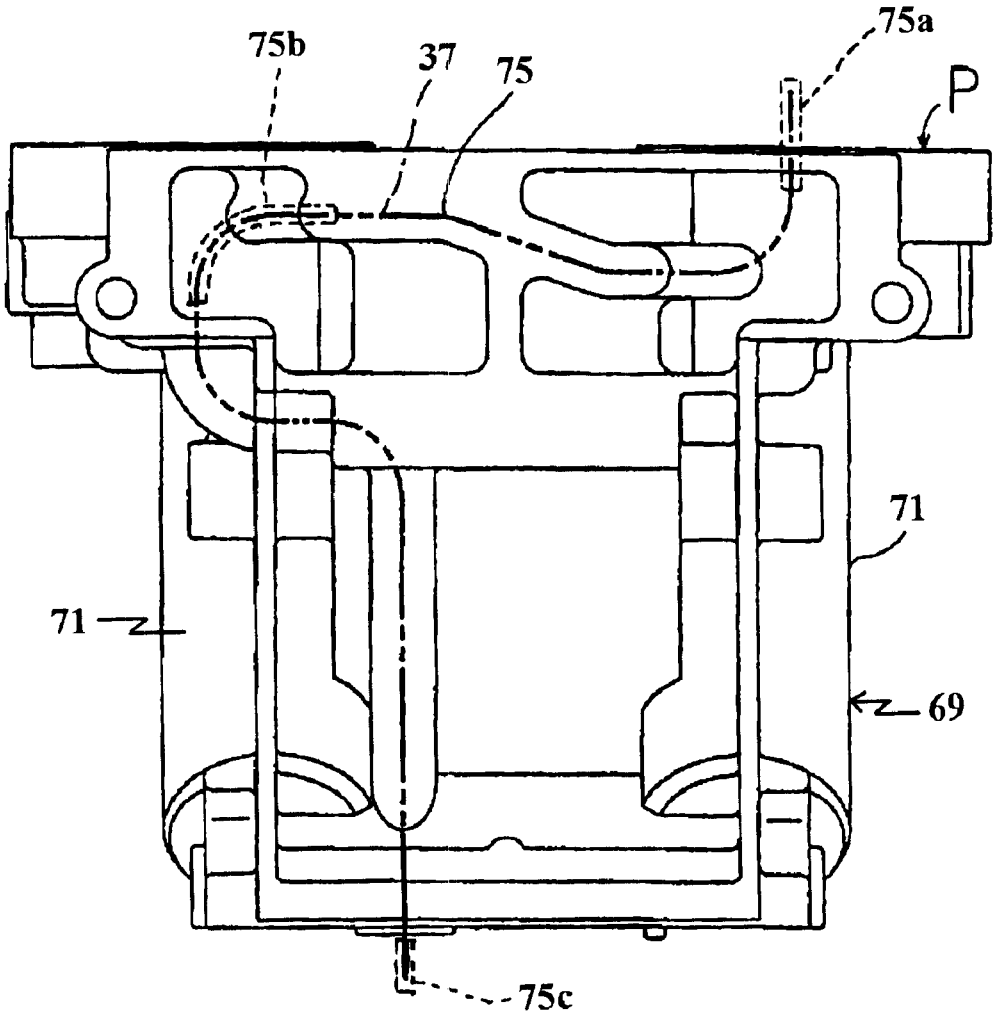
FIG. 12 is a view, in part similar to FIG. 6, but shows only the casting, which embodies the invention.

A part of the before-mentioned hydraulic passages shown in FIG. 3 are formed by casting the cast main body 69 around a bent steel oil pipe 75. The shape of the oil pipe 75 in this embodiment is shown in FIGS. 9–11 .Of course the shape chosen will be dictated by the locations of the components to be hydraulically connected.

The oil pipe 75 in a state after being cast-in into the cast main body 69 is shown by the double dot and dash lines in FIGS. 4–8 and 12–14. The oil pipe 75 communicates an upper part of the oil reservoir chamber 73 and a side of the hydraulic pumping chamber 72, and extends from the bottom of the hydraulic pumping chamber 72 and through the bottom of the cast main body 69.

After the casting-in, three parts of the oil pipe 75 are exposed. These exposed portions are shown by surrounding with dotted lines in the drawings, and comprise a protruding upper end portion 75*a* on the side of the oil reservoir chamber 73, an exposed, intermediate portion 75*b* exposed between the side and the bottom of the hydraulic pumping chamber 72, and a lower end portion 75*c* protruding from the bottom of the cast main body 69. The protruding end portions 75*a* and 75*c* may be utilized to hold and locate the pipe 75 during the casting process.

In order to better understand which of the passages shown in FIG. 3 are formed in whole or in part by the bent steel oil pipe 75 the reference numerals used in FIG. 3 have been added where appropriate in FIGS. 4–8 and 12–14. Thus, the lower part of the reservoir forming member 34 and the sides of the hydraulic pumping chamber 72 are communicated by the hydraulic passage 37 formed by the cast-in pipe (oil pipe 75). Also the hydraulic passage 47 on the discharge-side of the pump extending from the bottom of the hydraulic pumping chamber 72 and through the bottom of the cast main body 69 is formed by the cast-in pipe (oil pipe 75).

The upper end portion 75*a* of the oil pipe 75 exposed in the oil reservoir chamber 73 is cut off such that the opening of the oil pipe is slightly lower than the dividing surface P. Thereby, air in the hydraulic passage is allowed to escape into the oil tank and oil can be securely supplied to the hydraulic pumping chamber 72 without drawing air from the oil reservoir.

The lower end part 75*c* of the cast-in oil pipe 75 is cut off leaving a sufficient length to be connected to a hydraulic passage 61 formed by an pipe for communicating with the tilt cylinder 31. The hydraulic passage 49 to the trim cylinders 28 crossing the hydraulic passage 47 formed by the cast-in pipe 75 is bored or drilled at a lower part of the cast main body 69. The hydraulic passages 52 and 53 communicating the hydraulic passage 49 with each of the trim cylinders 28, respectively, are also bored or drilled.

Figure 14:
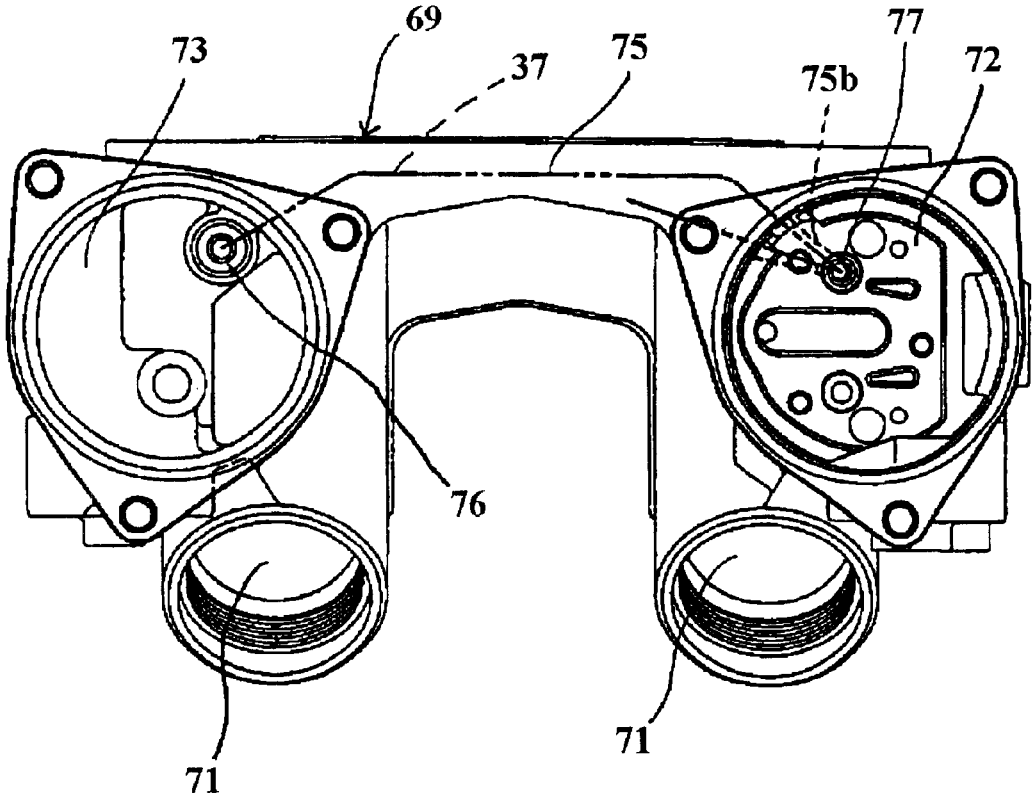
FIG. 14 is a top plan view, in part similar to FIG. 5, but showing only the casting embodying the invention.

The end part of the oil pipe 75 extending vertically upward in the oil reservoir chamber 73 is surrounded and supported by a cast material 76 of the cast main body 69 (FIG. 14). The oil pipe 75 in the hydraulic pumping chamber 72 extends downward through an opening77 formed in the bottom thereof.

Thus, from the foregoing description, it should be readily apparent that the described embodiment and method permits the casting of a hydraulic tilt and trim arrangement for a marine propulsion unit that minimizes the number of drilled passages and thus, improves the reliability of the system as well as reducing its costs. Of course, the specific embodiment and method disclosed is only those of preferred embodiments and various changes and modifications may be made without departing from the spirit and scope of the invention, as defined by the appended claims.

What is claimed is:

1. A cast housing for a hydraulic tilt and trim arrangement for a marine propulsion device, said cast housing defining a cylinder for receiving a piston for controlling the position of the marine propulsion device, a fluid reservoir for containing a fluid, a pumping chamber for containing a fluid pump, a valve chamber for containing a control valve, and a conduit for communicating said fluid reservoir with said valve chamber, said valve chamber with said cylinder, said valve chamber with said pumping chamber, at least a portion of said conduit being formed by a pipe molded into said cast housing when said cast housing is molded to minimize drilled passages in said cast housing and having a portion thereof extending outwardly beyond the body of said cast housing.

2. A cast housing as set forth in claim 1, wherein the outwardly extending portion of the pipe molded into the cast housing passes through at least one of the fluid reservoir, pumping chamber and valve chamber and that portion is removed after casting to provide two separate conduit portions.

3. A cast housing as set forth in claim 1, wherein the portion of the pipe extends outwardly beyond the cast housing is an end portion of said pipe and is connected to an external conduit of the hydraulic tilt and trim arrangement.

4. A cast housing as set forth in claim 1, wherein both end portions of the pipe extend outwardly beyond the cast housing.

5. A cast housing as set forth in claim 4, wherein one of the pipe end portions terminates in communication with the fluid reservoir, an intermediate portion of said pipe passes through the pumping chamber and the other end portion extends through the main body of said cast housing.

6. A cast housing as set forth in claim 5, wherein the fluid reservoir and the pumping chamber are formed by openings in an upper surface of said cast housing.

7. A cast housing as set forth in claim 6, wherein the intermediate portion of the pipe passing through the pumping chamber is removed after casting to provide two separate conduit portions.

8. A cast housing as set forth in claim 7, in combination with a reversible electric motor driving a reversible hydraulic pump mounted on said cast housing with said pump positioned at least in part in the pumping chamber, and a reservoir forming member mounted on said cast housing in closing relation to the fluid reservoir.

9. A method for forming a cast housing for a hydraulic tilt and trim arrangement for a marine propulsion device, said method comprising forming a pipe, casting a housing defining a cylinder for receiving a piston for controlling the position of the marine propulsion device, a fluid reservoir for containing a fluid, a pumping chamber for containing a fluid pump, a valve chamber for containing a control valve, around the pipe and forming a conduit for communicating the fluid reservoir with the valve chamber, the valve chamber with the cylinder, the valve chamber with the pumping chamber, at least a portion of the conduit being formed by the pipe to minimize drilled passages in said cast housing.

10. A method for forming a cast housing as set forth in claim 9, wherein the pipe passes through at least one of the fluid reservoir, pumping chamber and valve chamber and further including the step of removing that portion after casting to provide two separate conduit portions.

11. A method for forming a cast housing as set forth in claim 9, wherein at least a portion of the pipe extends outwardly beyond the cast housing.

12. A method for forming a cast housing as set forth in claim 11, wherein the portion of the pipe extends outwardly beyond the cast housing is an end portion of the pipe and further comprising the step of connecting that pipe end portion to an external conduit of the hydraulic tilt and trim arrangement.

13. A method for forming a cast housing as set forth in claim 11, wherein both end portion of the pipe extend outwardly beyond the cast housing.

14. A method for forming a cast housing as set forth in claim 13, wherein one of the pipe end portions terminates in communication with the fluid reservoir, an intermediate portion of said pipe passes through the pumping chamber and the other end portion extends through the main body of said cast housing.

15. A method for forming a cast housing as set forth in claim 14, wherein the fluid reservoir and the pumping chamber are formed by openings in an upper surface of said cast housing.

16. A method for forming a cast housing as set forth in claim 15, further including the step of removing the intermediate portion of the pipe after casting to provide two separate conduit portions.

17. A method for forming a cast housing as set forth in claim 16, further including the steps of mounting a reversible electric motor driving a reversible hydraulic pump on the cast housing with the pump positioned at least in part in the pumping chamber, and mounting a reservoir forming member on the cast housing in closing relation to the fluid reservoir.

* * * * *